US005941437A

United States Patent [19]

Okumura

[11] Patent Number: 5,941,437

[45] Date of Patent: Aug. 24, 1999

[54] STROLLER BAG

[76] Inventor: Kimberly Hiroshige Okumura, 411 Nevada St., El Segundo, Calif. 90245

[21] Appl. No.: 08/967,812

[22] Filed: Nov. 12, 1997

Related U.S. Application Data

[60] Provisional application No. 60/030,560, Nov. 14, 1996.

[51] Int. Cl.[6] ..... A45C 15/00

[52] U.S. Cl. ..... 224/585; 224/586; 224/600; 224/645; 224/646; 383/4; 383/16

[58] Field of Search ..... 224/585, 584, 224/600, 607, 620, 645, 572, 578, 579, 580, 586, 518, 577; 280/30, 35, 642, 643; 383/38, 24, 16, 4, 40; 150/107, 108

[56] References Cited

U.S. PATENT DOCUMENTS

| | | | |
|---|---|---|---|
| 2,557,280 | 6/1951 | Hahn | 383/4 |
| 2,697,465 | 12/1954 | Johnson | 383/4 |
| 3,151,649 | 10/1964 | Mitchell, Jr. | 383/22 |
| 3,164,187 | 1/1965 | Simmons | 150/112 |
| 4,186,859 | 2/1980 | Frankfort et al. | 224/585 |
| 4,535,878 | 8/1985 | Grahl | 190/1 |
| 4,545,414 | 10/1985 | Baum | 224/580 |
| 4,961,522 | 10/1990 | Weber | 224/585 |
| 5,439,154 | 8/1995 | Delligatti | 224/601 |
| 5,503,476 | 4/1996 | Hamdan | 224/653 |
| 5,702,038 | 12/1997 | Miller et al. | 224/409 |
| 5,743,649 | 4/1998 | Gonzalez | 383/6 |

*Primary Examiner*—Allan N. Shoap
*Assistant Examiner*—Maerena W. Brevard
*Attorney, Agent, or Firm*—Beehler & Pavitt; William H. Pavitt, Jr.; Jerry Noh

[57] ABSTRACT

A stroller bag fabricated from a lightweight, durable, easily cleaned material is described. The stroller bag includes a carrier having an upper end, a lower end, a front side, a back side, a first side and a second side. A flexible strap is attached adjacent the upper end of the carrier extending from the first side to the second side. The strap has a first end and a second end and includes means, adjacent the first and second ends, for removably attaching a portion of the strap back onto itself so as to form a pair of small loops. These loops are used to attach the carrier to the horizontal handle of a stroller. When the loops are unfastened from the stroller the strap may serve as a means for suspending the carrier from the neck or shoulder of a caregiver using the stroller bag. The stroller bag also includes a cinch belt, constructed of two portions of strapping material attached at the first side and second side of the carrier adjacent its upper end. The two strapping portions are joined with a pair of mating buckle ends that provide means for tightening the cinch belt. The cinch belt may be fastened about the waist of the caregiver for added comfort when transporting the stroller bag. The carrier includes means for attaching the upper end to the lower end so as to make the stroller bag more compact when suspended from the neck or shoulder of the caregiver. Such means may include Velcro fasteners, snaps or a zipper. The stroller bag may be constructed with one or more open or closeable pouches or pockets affixed to the front side or back side of the carrier. Some of these pouches or pockets may include inner pockets within them. The carrier is typically rectangular in shape, although other shapes are contemplated.

15 Claims, 4 Drawing Sheets

STROLLER BAG

RELATED APPLICATION

The following Application for Letters Patent claims priority from Provisional Application Serial No. 60/030,560, filed Nov. 14, 1996.

FIELD OF THE INVENTION

This invention falls in the field of what may be termed infant or baby products. More particularly, the invention involves a type of carrier that may be formed from a durable material that can be easily cleaned. The carrier has a number of pockets, the openings of at least some of which may be temporarily secured. The carrier also has means to enable the it to be disposed and supported over the handle of a stroller or on the person of the mother, nanny, guardian or caretaker tending a child.

BACKGROUND OF THE INVENTION

Ever since perambulators were first devised to receive and transport an infant in a comfortable position, the caregiver has been confronted with the desirability of carrying bottles, diaper changes, teething rings and other items which she may desire to utilize in the course of a walk with the child-carrying perambulator. When the perambulator was in the form of an oversized four-wheeled cradle, it was possible for the caregiver to provide for the transportation of such articles by simply tucking them in comers of the cradle about and away from the infant. However, beginning around the 1960's, the old type of perambulator has been increasingly superseded by a more convenient collapsible "stroller".

Strollers are generally light weight in construction, consisting of an arrangement of tubing extending upwardly from axles and supporting a canvas or other fabric type of seat, the position of which may be varied through adjustment of the tubing, between a sitting position and a supine position. The actual body support of canvas or other fabric, however, is generally unsuitable for enabling the caregiver to carry, in addition to the infant, other required items. Typically, such items include feeding bottles, diaper changes, baby powder or baby oil, teething rings, jacket or sweaters, crackers or other type of food and other items which the caregiver may desire to provide the infant during the course of what may become a long "outing". In addition, the caregiver may desire not to have to carry a purse but yet may need to have with her keys, money, lipstick and other items.

In U.S. Pat. No. 5,290,049 there is shown attached to a stroller a large partially collapsible "goods container". While this goods container may enable the caregiver to carry many items, it appears that all the items will be indiscriminately stacked together so that the caregiver is required to "fish into" the bag in order to find whatever item or items at that time may be desired.

U.S. Pat. No. 5,011,221 also discloses a baby carrier having a wedge-shaped separate storage pouch that may be carried between the rockers.

In addition, various devices are illustrated in U.S. Pat. Nos. 5,333,769, 5,292,042, 5,402,869, 4,878,606 and 4,545,414 that may be carried on one's person at the hips or over the shoulder into which articles may be placed. These, however, are cumbersome and with the exception of the carrier of U.S. Pat. No. 5,333,769, are not particularly suited for use in tending an infant. The device of the last mentioned patent, which provides for carrying of the infant as well as any other items, would appear to place considerable stress on the caregiver.

What has been particularly needed for use in conjunction with a stroller is some type of light carrier which at the caregiver's election may be placed on the stroller or, alternatively, conveniently carried about the hips, shoulder or back of the caregiver without discomfort.

The only carrier of which the present inventor is aware is in the form of an opaque plastic backing sheet near to the top of which is attached a plastic pouch, and at the midsection of the backing sheet there is provided a net bag to receive items. Provision is made at the top of the backing sheet for a carrying handle and a pair of buckleable straps to secure the carrier on the handle of the stroller.

While this carrier does attempt to address the need for some type of carrier, its stiffness, types of pouches and handle straps leave much to be desired. It must either be hung on the stroller or carrier by its handle. It does not lend itself to being worn by the caregiver when not disposed on the stroller.

SUMMARY OF THE INVENTION

The present invention comprises a relatively light carrier which may be rectangular in shape and is preferably made of a durable material which can be easily cleaned, or of some other material, even plastic, which will be comfortable when hung on the shoulder or about the waist of the caregiver. The carrier is provided at its upper end with a strap extending from one side to the other. The strap may be folded back upon itself at two places to form a pair of loops, preferably removably held together by VELCRO strips, in such a way as to enable the loops to be passed over the handle of the stroller to support the carrier. The length of the carrier should be such that, when it is hanging down from the stroller handle, it does not reach the ground. Likewise, the carrier would not reach the ground if the straps were brought around the waist of the caregiver and temporarily secured together for carrying by the caregiver if she chose to wear it in an apron-like manner.

It is a principal feature of the present invention to provide a plurality of pockets, preferably some on each side of the rectangle with the pockets being of different sizes and configurations to receive different types of items. For example, one size pocket on the side of the rectangle facing the caregiver when the carrier is hung on a stroller handle, which pocket may be specifically designed to hold a plurality of diapers for changing; another, for one or more bottles and/or food. On the opposite side, a pocket may be provided to receive other items that may be needed during the outing. Other pockets to hold particular items, such as crackers or SWEIBACH, teething rings, play rings, dolls or other toys may be provided on either side of the rectangle. In addition, a pocket may be provided within a pocket and along its back wall to receive keys, money, or other small items which the caregiver may, from time to time, desire to have handy. Such a pocket would be concealed from view or easy access in order to decrease the chance of theft when the caregiver is away from the stroller. Provision may be made for securing the pocket entrance areas temporarily as by VELCRO fasteners, snaps or zippers.

The material may be attractively decorated on at least one, if not both sides, so that the entire carrier may be aesthetically pleasing. It may also be adapted for folding and retention temporarily in folded disposition to enable it to be comfortably carried by the caregiver over her shoulder or otherwise upon removal from the stroller, or about her waist.

The carrier of the present invention thus may have great utility from the standpoint of a caregiver. Such a carrier permits the caretaker to take her infant out in a stroller and have conveniently at hand all of the items which she may need or desire to tend the infant in the stroller even over a prolonged period.

DESCRIPTION OF THE DRAWINGS

In the accompanying drawings.

DESCRIPTION OF THE PREFERRED EMBODIMENT

Figure 1:
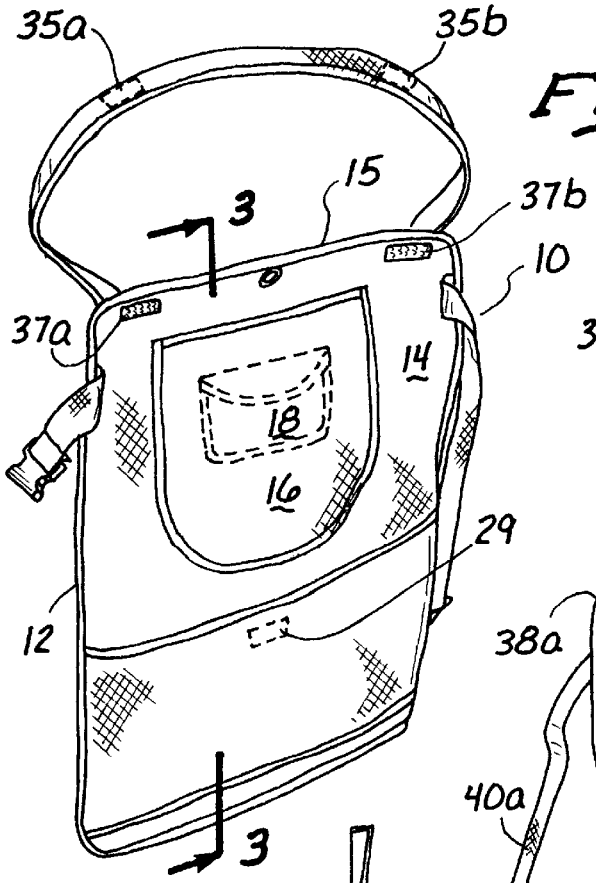
FIG. 1 is a perspective view of an embodiment of the carrier constructed in accordance with the present invention, taken of the side disposed to face the stroller.

Referring to FIG. 1 of the drawings, a carrier 10, prepared in accordance with the present invention, is formed about a generally rectangular flexible base 12 which preferably may be in the form of an attractive lightweight material fabric. The forward side 14 (i.e. the side facing the stroller) of the carrier, shown in FIG. 1, may be provided with an outer pocket 16 within which may be disposed a small inner pocket 18. The opposite side 20 shown in FIG. 2 may be provided with a pair of upper pockets 22 and 24, each of which may be open at all times. Near the base of the side 20 of the carrier 10 may be disposed a large closeable pouch-like pocket 26. The closing of this pocket being effected by means of a small VELCRO hook strip 28, stitched or otherwise secured to the underside of the pouch cover 30, and a hook receiving strip 29, secured in the top of the forward wall 32 of the pouch 26, to which the VELCRO 28 may be attached.

Figure 2:
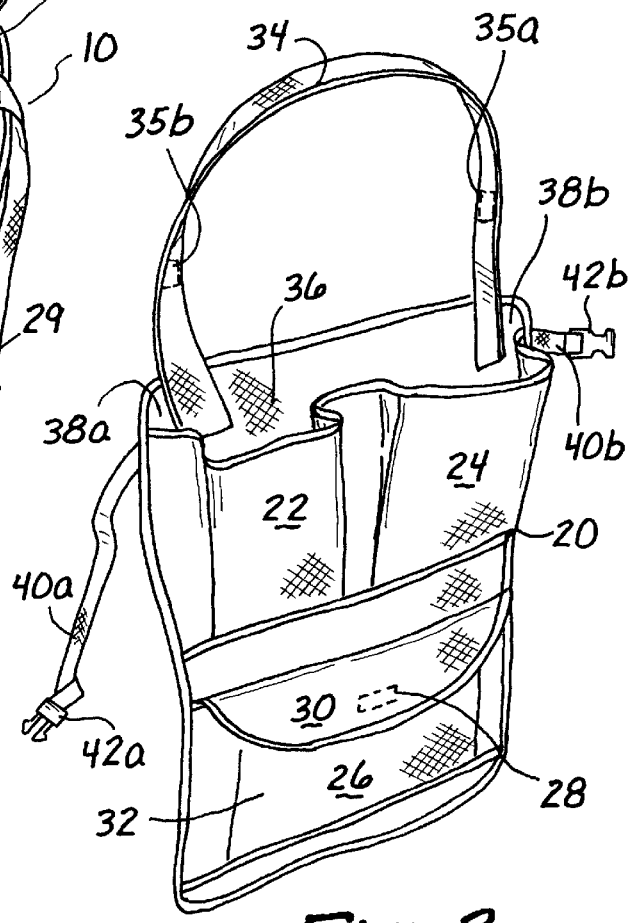
FIG. 2 is a perspective view of the opposite side of the carrier shown in FIG. 1.
Figure 3:
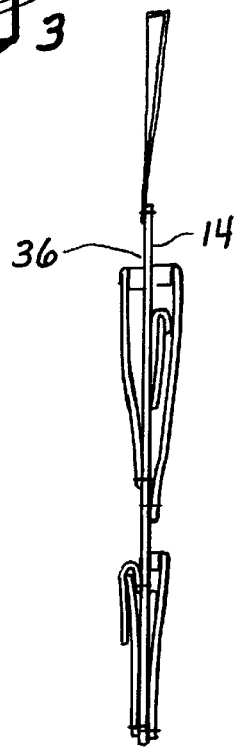
FIG. 3 is a section taken on the line 3—3 of FIG. 1.

FIGS. 1–3 show one type of pouch arrangement. However, it is within the scope of the present invention to provide different pouch arrangements on either or both walls 14 and 36 of the carrier; and while FIGS. 1–3 feature VELCRO type closures, a zipper closeable pouch 48 could be provided as shown in FIG. 4A in lieu of the pouch 26 shown in FIGS. 2 and 3.

Desirably, a carrying strap-like loop 34 should be secured, as by stitching or other means, along the top of the back wall 36 of the carrier near the side corners 38*a* and 38*b*. The strap loop 34 may be provided with a pair of VELCRO hook or loop patches 35*a*, 35*b*, with mating patches 37*a*, 37*b*, being secured along the rim 15 of the forward wall 14. In addition, two straps 40*a* and 40*b* which, when joined at their buckled ends 42*a* and 42*b*, respectively, may be provided to serve as a cinching belt 44 when the buckled ends 42*a* and 42*b* are brought together.

In use, the carrier 10 may be hung over the top bar 46 of a stroller 11 by means of the strap-like loop 34 which is brought together back upon itself by means of the VELCRO patches 35*a*, 35*b* joined respectively to mating VELCRO patches 37*a*, 37*b* to form a pair of small loops 34*a*, 34*b* over the stroller handle bar 46. Various articles may be inserted in the pockets of the carrier as, for example, clean diapers and/or formula-filled bottles could be inserted and retained in either or both of the pockets 22 and 24 on the rear wall 36 of the carrier 10. Other items could be placed in the pouch 26. Other items could be placed in the forward side pocket 16 and valuables, such as a driver's license, credit cards and money, could be placed in the inner pocket 18. Thus, the carrier of the present invention serves very convenient and practical purposes when mounted on the stroller handle 46.

Figure 4:
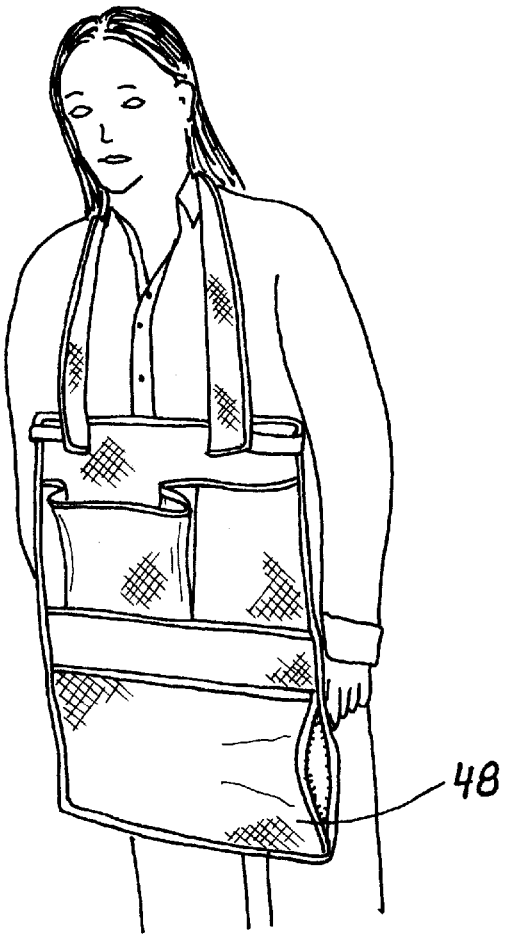
FIG. 4 illustrates the manner in which the carrier of the present invention may be disposed over the neck and shoulders of a person.
Figure 8:
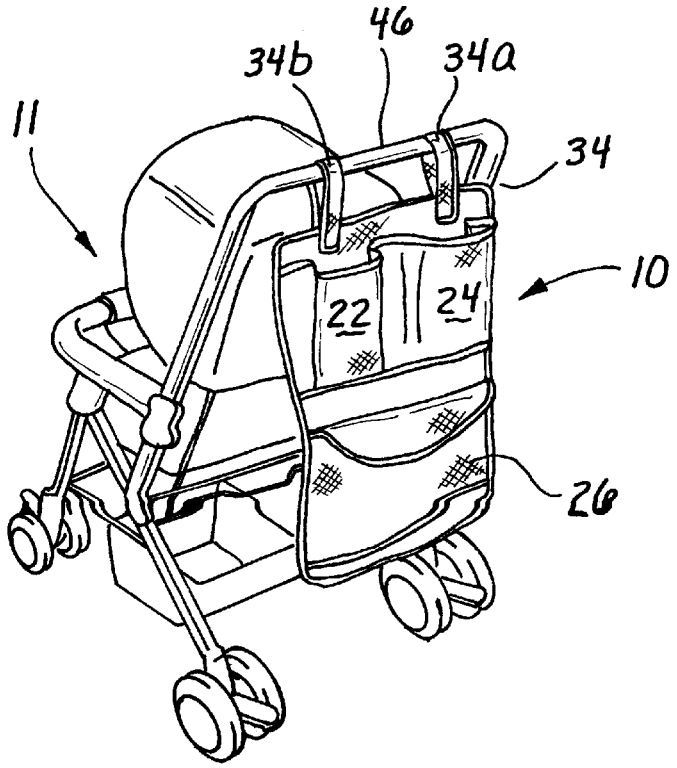
FIG. 8 is a perspective view of a stroller on which the carrier of the present invention is mounted.
Figure 4A:
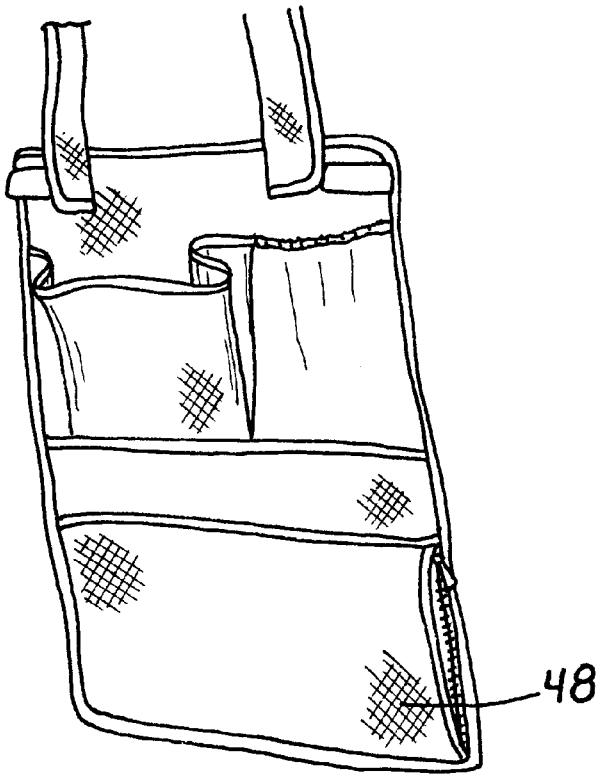
FIG. 4A illustrates the embodiment of the carrier having the zipper closeable pouch.
Figure 5:
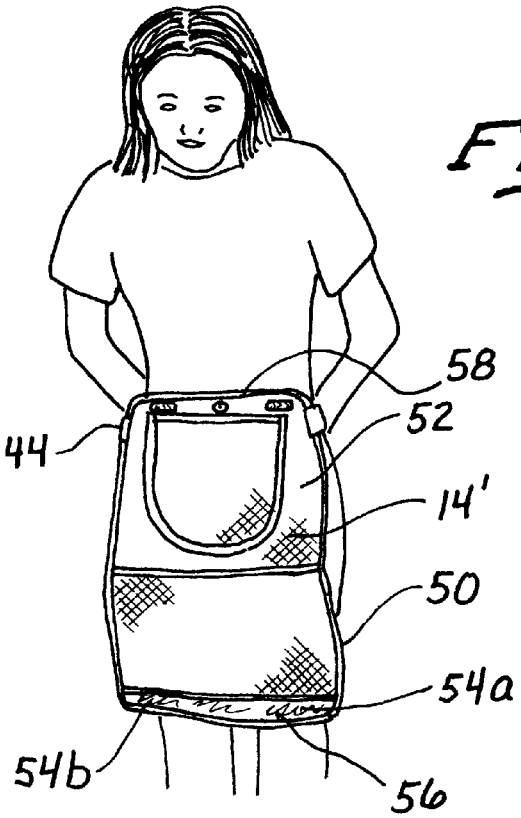
FIG. 5 shows the manner in which the carrier may be worn about the waist of a person.

The carrier, however, also lends itself to being fitted over the caregiver as, for example, by placing the strap-like loop 34 over the caregiver's neck to allow the carrier to be worn in the manner shown in FIG. 4. On the other hand, if the caregiver finds using the strap-like loop 34 as a halter to be uncomfortable and does not want the contents of the pockets 22 and 24 or the pouch 26 to rub against her at the height at which they will be disposed when the strap-like loop 34 is worn as a halter, the carrier may either be reversed or cinched about her waist in belt-like fashion as shown in FIGS. 5 and 6, or carried on one shoulder as shown in FIG. 7.

Figure 7A:
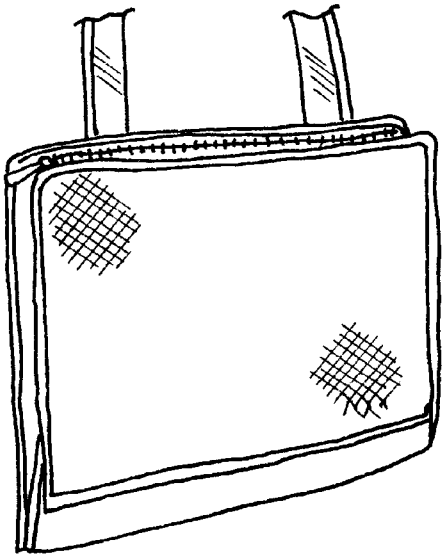
FIG. 7A illustrates the carrier folded upon itself and further illustrates the zipper engagement of the abutting edges of the upper and lower halves.
Figure 6:
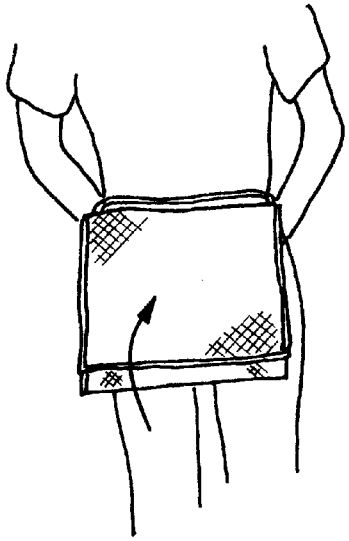
FIG. 6 is similar to FIG. 5, but shows the carrier folded upon itself where it is secured for more convenient carrying.
Figure 7:
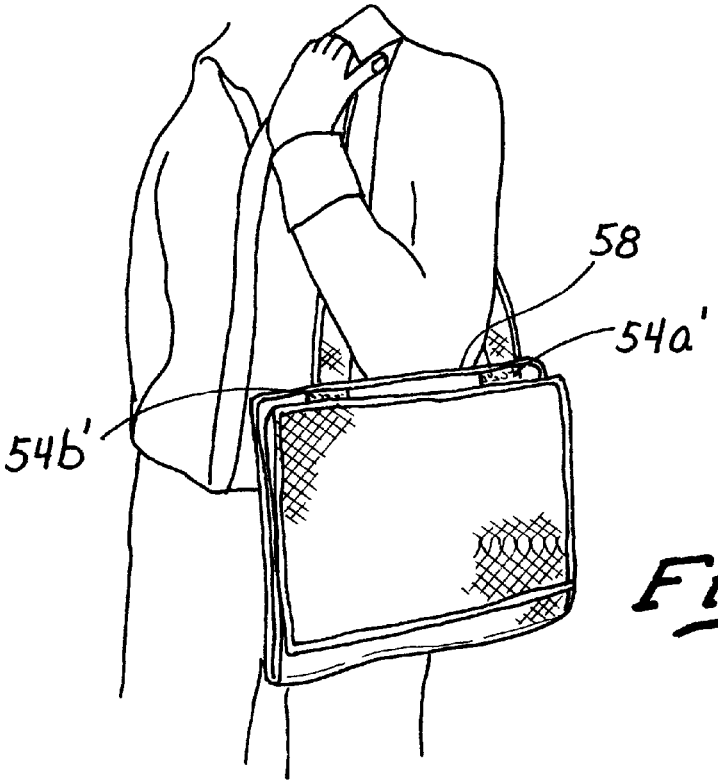
FIG. 7 illustrates the manner in which the carrier, when folded upon itself, as shown in FIG. 6, may be conveniently carried by the strapping over the caregiver's shoulder.

It will be noted that in FIGS. 6 and 7, the lower half 50 of the carrier 10 has been brought up and secured to the upper half 52, thereby better to facilitate its being carried at the caregiver's waist or shoulder. This may be accomplished by providing cooperating VELCRO strips 54*a*, 54*b*, on the lower edge 56 of the back side wall 36' and strips 54*a*' and 54*b*' on the upper edge 58 of the latter wall. When the lower edge 56 is brought up into contact with the upper edge 58, it may be removably held in that disposition by pressing together the cooperating VELCRO strips 54*a*, 54*b* with strips 54*a*', 54*b*'. Alternatively or in addition, the abutting edges of the upper and lower halves 52, 50 could be provided with a zipper engagement as shown in FIG. 7A.

While particular arrangements of pockets are illustrated in the drawings and discussed above, the pocket arrangement may be varied in many ways within the spirit of the present invention. Also, it is not necessary that the carrier be provided with the belt portions 40*a* and 40*b*, in which case, the caregiver or nanny who desires to wear the carrier will have to do so in the manner shown in FIGS. 4 or 7. The carrier 10, with or without the belt portions 40*a* and 40*b*, will always be mountable on the stroller by its strap-like loop 34. The carrier of the present invention may also be utilized in an automobile where a seat has a headrest. The strap 34 is simply looped over the headrest (not shown) and disposed against the front or rear of the seat, thereby enabling bottles and other items to be supported against tilting which could result in spillage of the contents.

From the accompanying drawings and foregoing description, it will be appreciated that the carrier 10 of the present invention fulfills a need that has existed since the substitution of strollers for perambulators. The carrier provides an effective and convenient means for a caregiver to carry what she may need in the course of an outing with a baby being pushed in a stroller. Also, because of the ability of the caregiver to wear the carrier, it offers the convenience of enabling the wearer to move about her residence, to pick up and store what is expected to be needed in the course of an outing and, when the carrier is filled, the carrier, with its pocketed contents, may then be simply slipped over the handle of the stroller and thus used for the outing.

The carrier of the present invention thus offers many advantages over what has heretofore been available for caregivers who may desire to take an infant or small child on an outing.

I claim:

1. A stroller bag, comprising:

a lightweight carrier, said carrier being generally rectangular in shape and formed of a sheet of durable fabric having first and second side edges and further having a front side, a back side, an upper end, a lower end, an upper half, a lower half foldably joinable to said upper half;

a strap affixed at the upper end of the sheet, said strap having a first end and second end, and extending from a point adjacent the first side to a point adjacent the second side;

said strap having a first means, adjacent the first end of the strap for removably attaching a portion of the strap to itself to form a first loop therein;

said strap having a second means, adjacent the second end of the strap, for removably attaching a portion of the strap to itself to form a second loop therein;

said first loop and said second loop serving to removably secure the stroller bag to a horizontal cross-piece of a stroller frame;

a least a pair of pockets and at least one pouch disposed upon the front side of said, and at least one pocket disposed on the back side of said sheet; and, means for removably attaching the lower end of the sheet to the upper end of the sheet when the sheet is folded to dispose the back of the lower half of the sheet to the back of the upper half.

2. A stroller bag as described in claim 1, further comprising:

a cinching belt, said belt having a first half and a second half;

said first half having a first end and a second end and being secured at said first end adjacent the first side edge of the sheet adjacent the upper end and;

said second half having a first end and a second end and being secured at said first end adjacent the second side edge of the sheet adjacent the upper end;

said second ends of the second halves of said belt having means for removably interlockingly engaging each other; and said cinching belt serving to removably secure the carrier about the waist of a caregiver when the strap of the carrier is disposed about the neck of the caregiver.

3. A stroller bag as described in claim 1, wherein the first means and the second means for removably attaching a portion of the strap to itself include a pair of mating snaps.

4. A stroller bag as described in claim 1, wherein the first means and the second means for removably attaching a portion of the strap to itself include a looping strip and a hooking strip.

5. A stroller bag as described in claim 1, wherein the carrier is formed of a lightweight, durable material that may be easily cleaned.

6. A stroller bag as described in claim 1, wherein the means for removably attaching the lower end of the carrier to the upper end of the carrier is at least one mating pair of snaps affixed to the upper end and the lower end of the carrier.

7. A stroller bag as described in claim 1, wherein the means for removably attaching the lower end of the carrier to the upper end of the carrier is at least one hooking strip and at least one hooking strip affixed to the upper end and the lower end of the carrier, respectively.

8. A stroller bag as described in claim 1, wherein the means for removably attaching the lower end of the carrier to the upper end of the carrier is a zipper having detachable ends, said zipper being affixed to the upper end of the carrier and to the lower end of the carrier.

9. A stroller bag as described in claim 1, further comprising at least one open pocket located adjacent the upper end of the carrier suitable for receiving a beverage container.

10. A stroller bag as described in claim 1, further comprising at least one closeable pouch suitable for receiving diapers.

11. A stroller bag as described in claim 1, further comprising at least one large closeable pouch-like pocket located adjacent the lower end of the carrier.

12. A stroller bag as described in claim 10, wherein the closeable pouch-like pocket is closed with a hooking strip and a mating looping strip.

13. A stroller bag as described in claim 10, wherein the closeable pouch-like pocket is closed with a zipper.

14. A stroller bag as described in claim 10, wherein the closeable pouch-like pocket has a first opening adjacent the first side of the carrier, leading to a first inner chamber, and a second opening adjacent the second side of the carrier, leading to a second inner chamber.

15. A stroller bag as described in claim 1, further comprising at least one outer pocket within which a smaller inner pocket is disposed.

* * * * *